US010352533B2

(12) United States Patent
Daijo et al.

(10) Patent No.: US 10,352,533 B2
(45) Date of Patent: Jul. 16, 2019

(54) LIGHT SOURCE DEVICE AND LIGHTING DEVICE

(71) Applicant: PANASONIC INTELLECTUAL PROPERTY MANAGEMENT CO., LTD., Osaka (JP)

(72) Inventors: Kazuhiro Daijo, Osaka (JP); Hiroyuki Yoshioka, Osaka (JP); Katsunori Kawabata, Kyoto (JP); Yoshimichi Enno, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 130 days.

(21) Appl. No.: 15/620,085

(22) Filed: Jun. 12, 2017

(65) Prior Publication Data

US 2018/0003361 A1 Jan. 4, 2018

(30) Foreign Application Priority Data

Jun. 29, 2016 (JP) ..... 2016-129371

(51) Int. Cl.

| | |
|---|---|
| ***F21V 7/08*** | (2006.01) |
| ***F21V 5/04*** | (2006.01) |
| ***F21V 13/04*** | (2006.01) |
| *F21V 29/89* | (2015.01) |
| *F21Y 105/18* | (2016.01) |
| *F21Y 113/17* | (2016.01) |
| *F21Y 115/10* | (2016.01) |
| *F21V 7/22* | (2018.01) |
| *F21V 7/00* | (2006.01) |
| *F21V 29/76* | (2015.01) |

(52) U.S. Cl.

CPC ..... *F21V 7/08* (2013.01); *F21V 5/045* (2013.01); *F21V 13/04* (2013.01); *F21V 7/0016* (2013.01); *F21V 7/22* (2013.01); *F21V 29/76* (2015.01); *F21V 29/89* (2015.01); *F21Y 2105/18* (2016.08); *F21Y 2113/17* (2016.08); *F21Y 2115/10* (2016.08)

(58) Field of Classification Search

CPC . F21V 7/0025; F21V 7/09; F21V 3/02; F21V 7/08

USPC ..... 362/297, 298

See application file for complete search history.

(56) References Cited

U.S. PATENT DOCUMENTS

2006/0203468 A1* 9/2006 Beeson ..... G02B 27/286 362/84

2008/0291682 A1* 11/2008 Falicoff ..... G02B 5/12 362/310

FOREIGN PATENT DOCUMENTS

| | | |
|---|---|---|
| JP | 2014-507779 | 3/2014 |
| WO | 2012/116139 | 8/2012 |

* cited by examiner

*Primary Examiner* — William J Carter

(74) *Attorney, Agent, or Firm* — Greenblum & Bernstein, P.L.C.

(57) ABSTRACT

In a light source device, an axis extends from a light-emitting face and perpendicularly to the light-emitting face. A reflective surface includes a curved surface defined by rotating a first arc which is a part of an ellipse around the axis. The ellipse has a first focal point and a second focal point which are located on the light-emitting face. The second focal point is located adjacently to the first arc with respect to a center of the ellipse. A distance from the first focal point to the axis is shorter than a distance from the second focal point to the axis.

20 Claims, 7 Drawing Sheets

LIGHT SOURCE DEVICE AND LIGHTING DEVICE

CROSS-REFERENCE TO RELATED APPLICATION

The present application is based upon and claims the benefit of priority of Japanese Patent Application No. 2016-129371, filed on Jun. 29, 2016, the entire contents of which are incorporated herein by reference.

TECHNICAL FIELD

The present disclosure relates to light source devices and lighting devices and, specifically, to a light source device including light-emitting elements and a lighting device including the light source device.

BACKGROUND ART

JP 2014-507779 A (hereinafter referred to as "Document 1") describes a Light Emitting Diode (LED) lighting system (light source device) as a conventional example. The LED lighting system described in Document 1 includes: an LED module (light source) including a substrate and an LED element (a light-emitting element) attached to the substrate; and a recycling reflector (a reflector) provided in front of the LED module. The recycling reflector has a transmission opening (opening) through which light from the LED module is transmitted. The recycling reflector includes an inner surface (a reflective surface) which is spherical with respect to the center of the LED element. The light emitted from the LED element and arrived at the inner surface without traveling to the transmission opening is reflected in a direction in which the light returns to the LED element itself. Some rays of the light returned to the LED element are reflected off the LED module and are extracted via the transmission opening to the outside of the recycling reflector. In this way, the LED lighting system enables efficient extraction of the light from the LED module to the outside of the recycling reflector.

However, the LED lighting system is not suitable for reflecting light emitted from an area of the substrate which does not correspond to the center of the inner surface of the recycling reflector by the inner surface to return the light to the LED element and extracting the light via the transmission opening to the outside of the recycling reflector. That is, a large portion of the light emitted from the area which does not correspond to the center of the inner surface is lost before the light is extracted to the outside of the recycling reflector, and thus, the light is not efficiently extracted to the outside of the recycling reflector.

SUMMARY

One of the objectives of the present disclosure is to provide a light source device and a lighting device which enables more effective extraction of light from a light source.

To achieve the objective, a light source device according to an aspect of the present disclosure includes a light source and a reflector. The light source includes light-emitting elements. The light source includes a light-emitting face being flat and formed of the light-emitting elements. The reflector has an opening on an axis. The axis extends from the light-emitting face and perpendicularly to the light-emitting face. The opening is located in an area inside a peripheral edge of the light-emitting face when viewed in a direction of the axis. Light emitted from the light source passes through the opening. The reflector includes a reflective surface which reflects light emitted from the light source toward the light source. The reflective surface includes a curved surface defined by rotating one arc which is a part of an ellipse around the axis. The ellipse is located coplanar with the axis. As the one arc is closer to the opening in the direction of the axis, the one arc is closer to the axis in a direction orthogonal to the direction of the axis. A first focal point and a second focal point in the ellipse including the one arc are located on the light-emitting face. The second focal point is located adjacently to the one arc with respect to a center of the ellipse including the one arc. A distance from the first focal point to the axis is shorter than a distance from the second focal point to the axis.

A lighting device according to one aspect of the present disclosure includes the light source device and a luminous intensity distribution member configured to control distribution of luminous intensity of light from the light source device.

BRIEF DESCRIPTION OF THE DRAWINGS

The figures depict one or more implementation in accordance with the present teaching, by way of example only, not by way of limitations. In the figures, like reference numerals refer to the same or similar elements.

DETAILED DESCRIPTION (First Embodiment)

Figure 1:
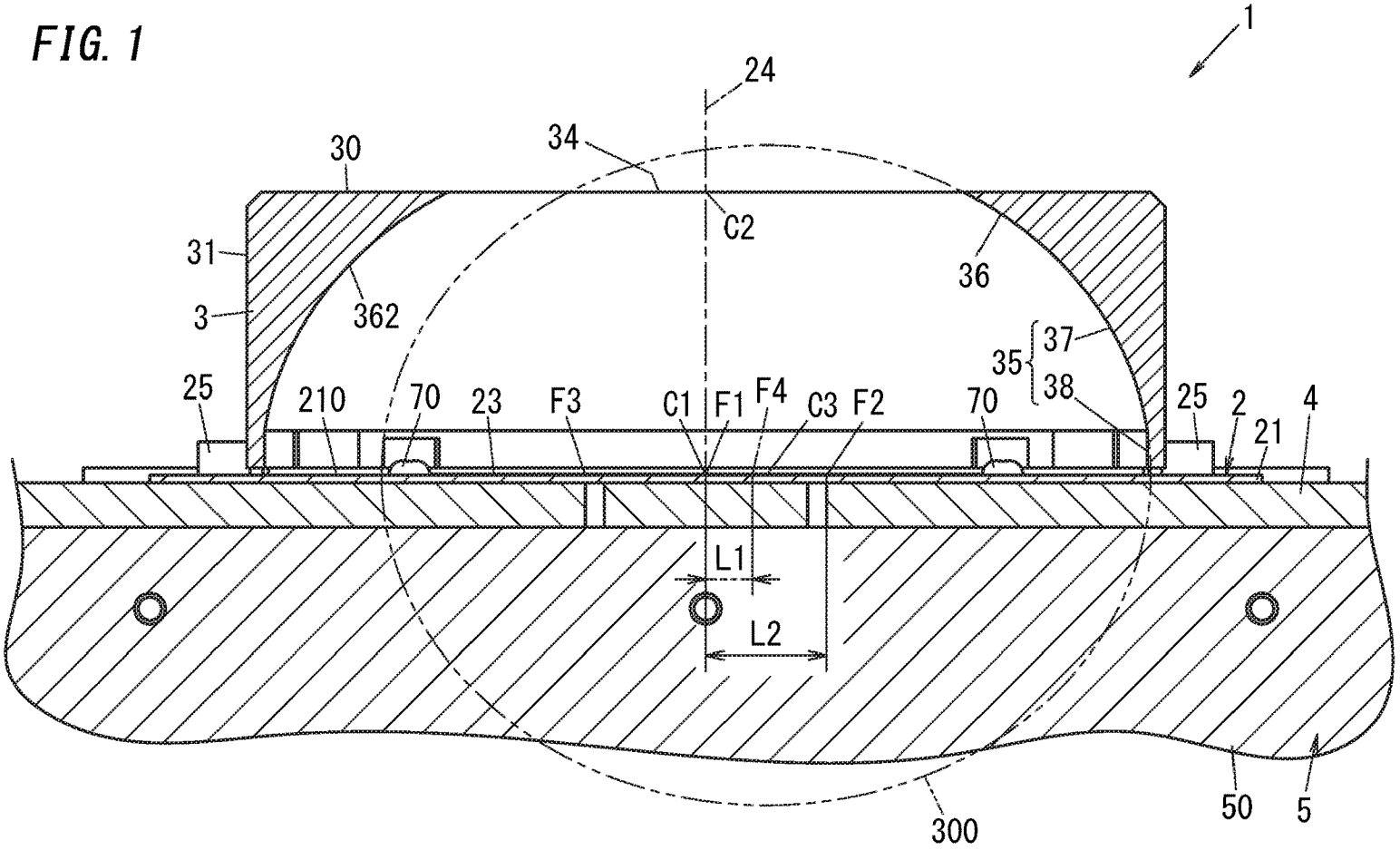
FIG. 1 is a sectional view illustrating a main portion of a light source device according to a first embodiment of the present disclosure.

A light source device and a lighting device according to a first embodiment will be described below with reference to the drawings. In the following description, the forward and rearward direction of a light source device 1 is defined as the upward and downward direction as defined in FIG. 3 unless otherwise indicated. FIG. 1 is a sectional view along line A-A in FIG. 2.

Figure 2:
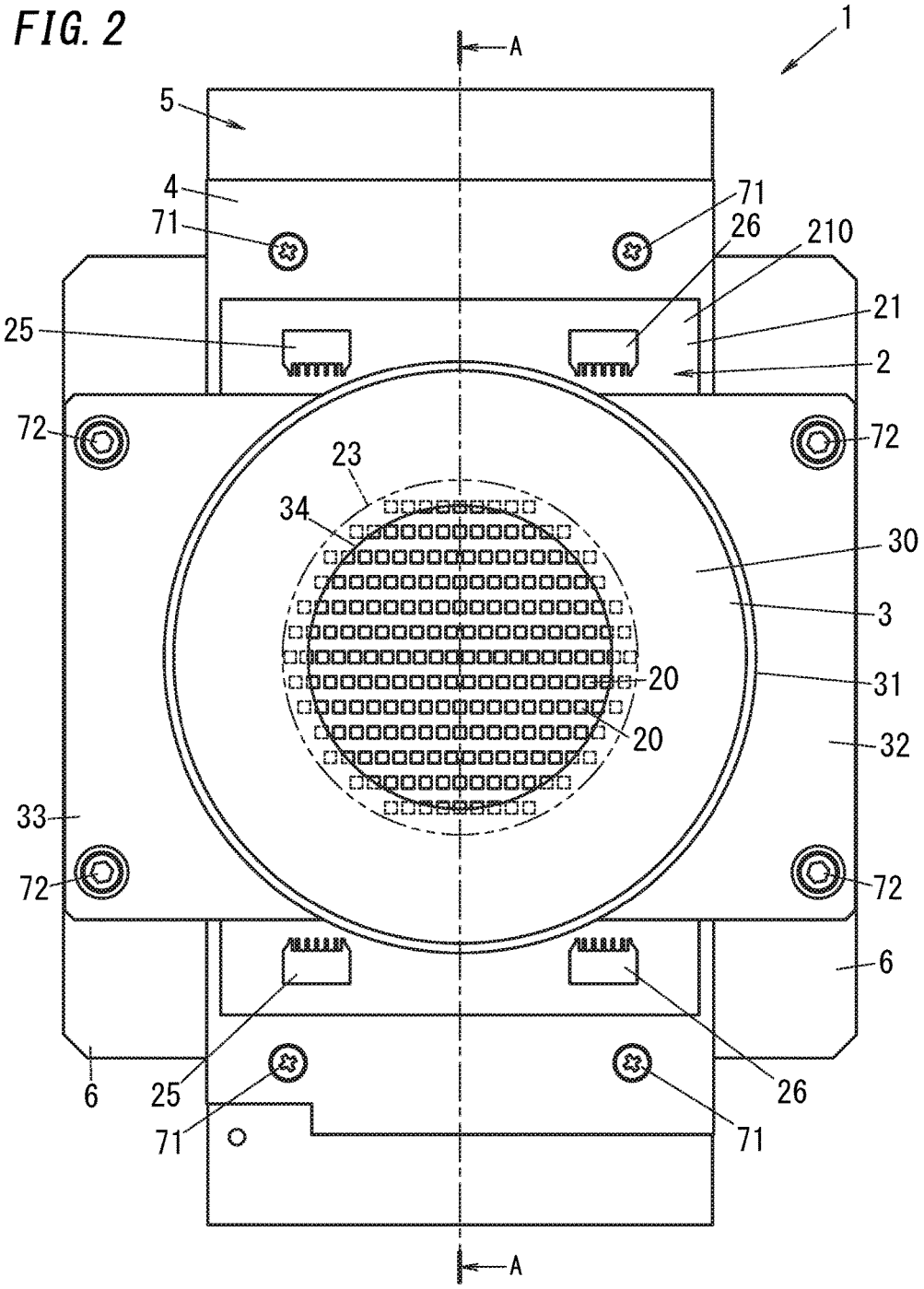
FIG. 2 is a plan view illustrating the light source device.

As illustrated in FIG. 2, the light source device 1 of the present embodiment includes a light source 2, a reflector 3, two attachments 32 and 33, a fixing plate 4, a heat sink 5, and two L-shaped angles 6.

The light source 2 includes (in FIG. 2, 210) light-emitting elements 20, a substrate 21, two anode-side connectors 25, and two cathode-side connector 26. The light-emitting elements 20 are mounted on the substrate 21.

The substrate 21 is made of, for example, an electrically insulative resin material to have a rectangular flat plate shape. The substrate 21 has one surface (front surface) 210 covered with white resist.

Each light-emitting element 20 is, for example, a Chip On Board (COB) LED element. The light-emitting elements 20 are arranged in a disk shape on the one surface 210 of the substrate 21. Specifically, the light-emitting elements 20 are arranged in columns which altogether form the disk shape. The light source 2 includes a light-emitting face 23. The light-emitting face 23 is formed of the light-emitting elements 20 to have a disk face shape. Moreover, the light-emitting fare 23 is flat. The light-emitting face 23 has a diameter of, for example, 50 mm. Light is emitted from the light-emitting face 23 mainly in a forward direction perpendicular to the light-emitting face 23. A half-line extending from the center C1 (see FIG. 1) of the light-emitting face 23 having the disk face shape perpendicular to the light-emitting face 23 in the forward direction is defined as an axis 24 (see FIG. 1).

The two anode-side connector 25 and the two cathode-side connector 26 are provided near respective four corners of the one surface 210 of the substrate 21. The two anode-side connectors 25 are connected to positive-electrode-side output terminals of a power supply circuit (not shown). The two cathode-side connectors 26 are connected to negative-electrode-side output terminals of the power supply circuit. The light-emitting elements 20 are divided into two groups. Each group includes two or more light-emitting elements 20. In each group, the light-emitting elements 20 are electrically connected in series, in parallel, or in series-parallel to each other. The two anode-side connectors 25 correspond to the two groups on a one-to-one basis. The two cathode-side connectors 26 correspond to the two groups on a one-to-one basis. Each anode-side connector 25 is electrically connected to an anode side of a corresponding one of the two groups. Each cathode-side connector 26 is electrically connected to a cathode side of a corresponding one of the two groups. In this way, the power supply circuit supplies power to the light-emitting elements 20.

Figure 3:
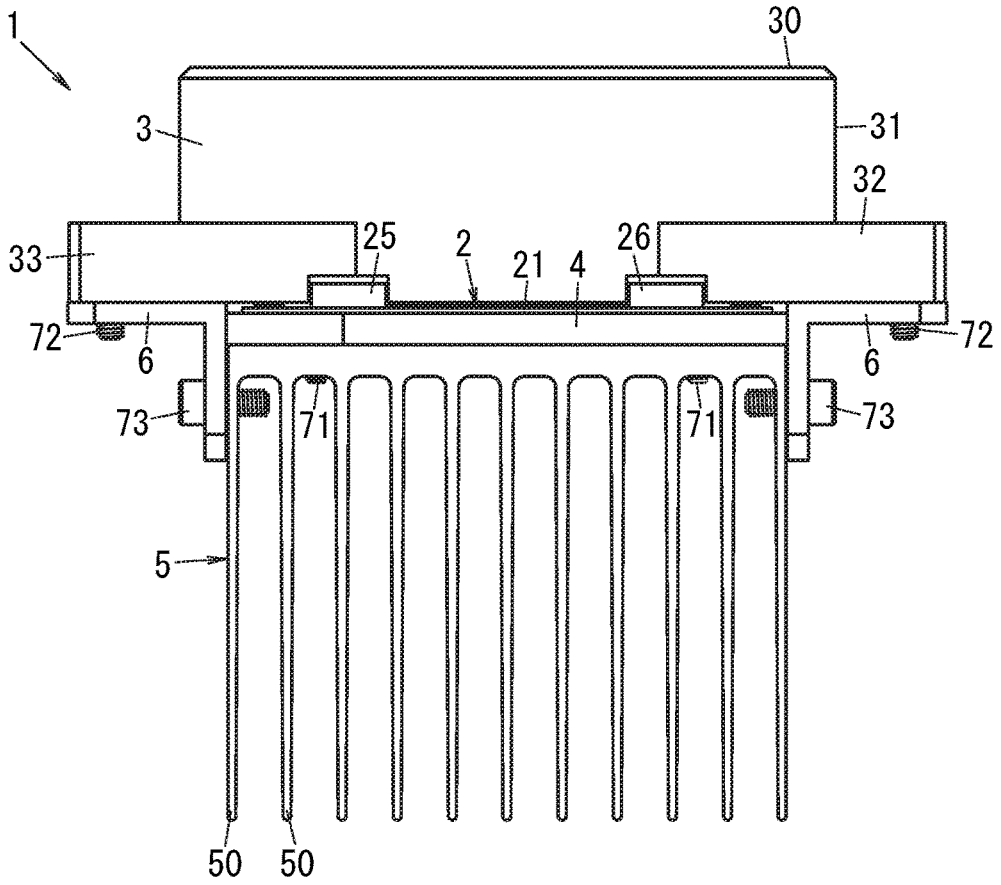
FIG. 3 is a side view illustrating the light source device.

The reflector 3 and the attachments 32 and 33 are integrally formed by metal spinning of a metal material such as aluminum. The reflector 3 has a substantially cylindrical shape. The reflector 3 has a front surface 30 which is an outer forward surface of the reflector 3 and has a disk face shape. The reflector 3 has an opening 34 having a circular shape at the center of the front surface 30. The front surface 30 has an outer edge from which an outer peripheral surface 31 extends rearward. As illustrated in FIG. 1, since a reflective surface 35 which is an inner surface of the reflector 3 is inclined outward in the rearward direction, the reflector 3 has a thickness which decreases from a forward side to a rear side. As illustrated in FIG. 3, the reflector 3 is provided with the attachments 32 and 33 protruding from an area including a rear end of the outer peripheral surface 31. The attachments 32 and 33 each have a thick plate shape. From the rear end of the outer peripheral surface 31, the attachment 32 protrudes in parallel to the front surface 30. At the rear end of the outer peripheral surface 31, the attachment 33 protrudes, from a side opposite to a position from which the attachment 32 protrudes, in a direction opposite to a direction in which the attachment 32 protrudes. The width of each of the attachments 32 and 33 is slightly smaller than the outer diameter of the front surface 30 in a direction (in the upward and downward direction in FIG. 2) perpendicular to both the forward and rearward direction and the directions in which the attachments 32 and 33 protrude from the outer peripheral surface 31. As illustrated in FIG. 1, the reflector 3 is disposed such that the center C2 of the opening 34 is on the axis 24. As illustrated in FIG. 2, the opening 34 has a diameter smaller than the diameter of the light-emitting face 23. Thus, when viewed in a direction of the axis 24 (the forward and rearward direction), an area where the opening 34 is formed is located inside a peripheral edge of the light-emitting face 23. Note that the reflector 3 may be made of an aluminum alloy.

As illustrated in FIG. 1, the reflector 3 has the reflective surface 35 on an inner side thereof. The reflective surface 35 is a metal surface on which aluminum forming the reflector 3 is exposed. Light emitted from the light source 2 includes rays arriving at the reflective surface 35, and the rays are reflected by the reflective surface 35 toward the light source 2. Specifically, the reflective surface 35 performs mirror reflection of light from the light source 2. The reflector 3 has a side-cross section having a shape shown in FIG. 1. That is, the side-cross section of the reflector 3 includes a first arc 36 (one arc) which is a part of an ellipse 300 on a side where the reflective surface 35 is provided. Specifically, the ellipse 300 is coplanar with the axis 24. Moreover, the reflective surface 35 (inner side surface) of the reflector 3 has a curved surface 37 defined by rotating the first arc 36 which is a part of the ellipse 300 around the axis 24 by 360 degrees.

Thus, the cross sectional shape of the reflector 3 taken along a line perpendicular to the axis 24 and passing the curved surface 37 of the reflective surface 35 is a circular shape or has a circular arc part with the axis 24 as the center. The cross sectional shape of the reflector 3 of the present embodiment taken along the line perpendicular to the axis 24 and passing through the reflective surface 35 is a circular shape.

The first arc 36 is located on a side (forward side) toward which the axis 24 extend from the light-emitting face 23 with respect to the light source 2. The closer the first arc 36 is to the opening 34 in a direction of the axis 24 (the forward and rearward direction), the closer the first arc 36 is to the axis 24 in a direction orthogonal to the direction of the axis 24 (a radial direction of the light-emitting face 23). That is, a point adjacent to the opening 34 (on a forward side) of the first arc 36 is closer to the axis 24 than a point adjacent to the light-emitting face 23 (on the rear side) of the first arc 36 is. A first focal point F1 and a second focal point F2 of the ellipse 300 including the first arc 36 are located on the light-emitting face 23. The second focal point F2 is located adjacently to the first arc 36 with respect to the center C3 of the ellipse 300 including the first arc 36. The first focal point F1 is located at the center C1 of the light-emitting face 23. That is, the first focal point F1 is located at an intersection of the light-emitting face 23 and the axis 24. The second focal point F2 is located on the light-emitting face 23 at a position near the outer edge of the light-emitting face 23. A distance L1 from the first focal point F1 to the axis 24 is shorter than a distance L2 from the second focal point F2 to the axis 24. That is, the axis 24 is closer to the first focal point F1 than the second focal point F2. Note that in the present embodiment, since the first focal point F1 is located at the center C1 of the light-emitting face 23, and the axis 24 passes through the center C1 of the light-emitting face 23, the distance L1 from the first focal point F1 to the axis 24 is zero. Since the reflective surface 35 has a rotationally symmetric shape to the axis 24, the reflective surface 35 includes a second arc 362 which is line-symmetric with the first arc 36 to the axis 24. A point F3 which is line-symmetric with the second focal point F2 to the axis 24 and the first focal point F1 are focal points of an ellipse (not shown) including the second arc 362.

Figure 4:
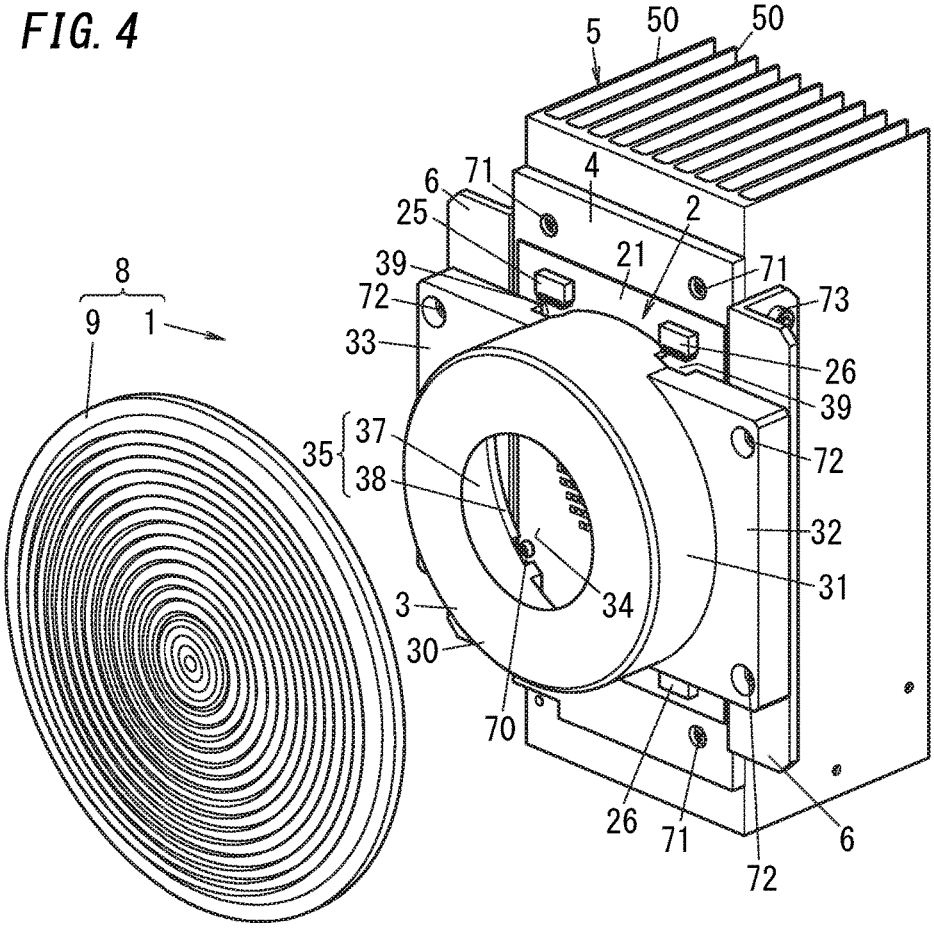
FIG. 4 is a perspective view illustrating a lighting device according to the first embodiment of the present disclosure when viewed from a front side.

The reflective surface 35 further includes a surface 38 behind the curved surface 37. The surface 38 is connected to the curved surface 37. As illustrated in FIG. 4, the surface 38 of the reflector 3 has four recesses 39 (only two of which are shown in FIG. 4). The four recesses 39 are formed near the respective two anode-side connectors 25 and two cathode-side connectors 26. Through each of the recesses 39, a terminal and a wire (not shown) are inserted. The terminal and the wire electrically connect each group of light-emitting elements 20 to a corresponding one of the anode-side connectors 25 or to a corresponding one of the cathode-side connectors 26.

The fixing plate 4 is in contact with the substrate 21 and is provided behind the light source 2. As illustrated in FIG. 1, the fixing plate 4 is fixed to the substrate 21 with four screws 70 (only two of which is shown in FIG. 1). The fixing plate 4 is made of a material such as copper having excellent thermal conductivity to have a rectangular plate shape. The fixing plate 4 conducts heat generated by the light-emitting elements 20 of the light source 2 to the heat sink 5 provided behind the fixing plate 4.

The heat sink 5 is in contact with a rear surface of the fixing plate 4. As illustrated in FIG. 2, the heat sink 5 is fixed to the fixing plate 4 with four screws 71. The heat sink 5 is made of, for example, aluminum. As illustrated in FIG. 3, the heat sink 5 includes (in the embodiment, 11) fins 50 each having a rectangular flat plate shape. The fins 50 protrude rearward with respect to the fixing plate 4 and dissipate heat received from the fixing plate 4 into air.

Figure 5:
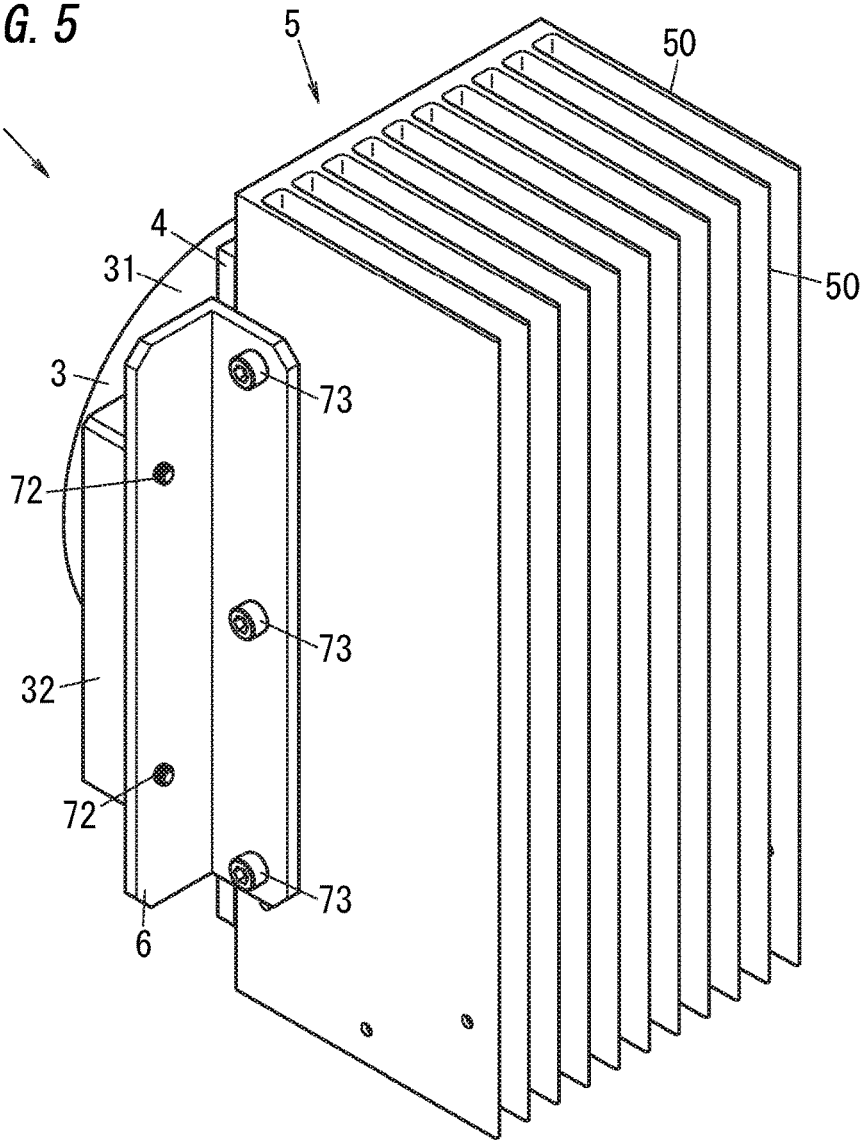
FIG. 5 is a perspective view illustrating the light source device when viewed from a rear side.

The two L-shaped angles 6 are made of, for example, a steel plate. As illustrated in FIG. 5, the two L-shaped angles 6 are formed to have a plate shape having an L cross section. Each L-shaped angle 6 fixes the attachment 32 or the attachment 33 (see FIG. 4) and also fixes the heat sink 5. That is, each L-shaped angle 6 is attached to the attachment 32 or the attachment 33 with two bolts 72 and is attached to the heat sink 5 with three bolts 73. In this way, the reflector 3 formed integrally with the attachments 32 and 33 is fixed.

Figure 6:
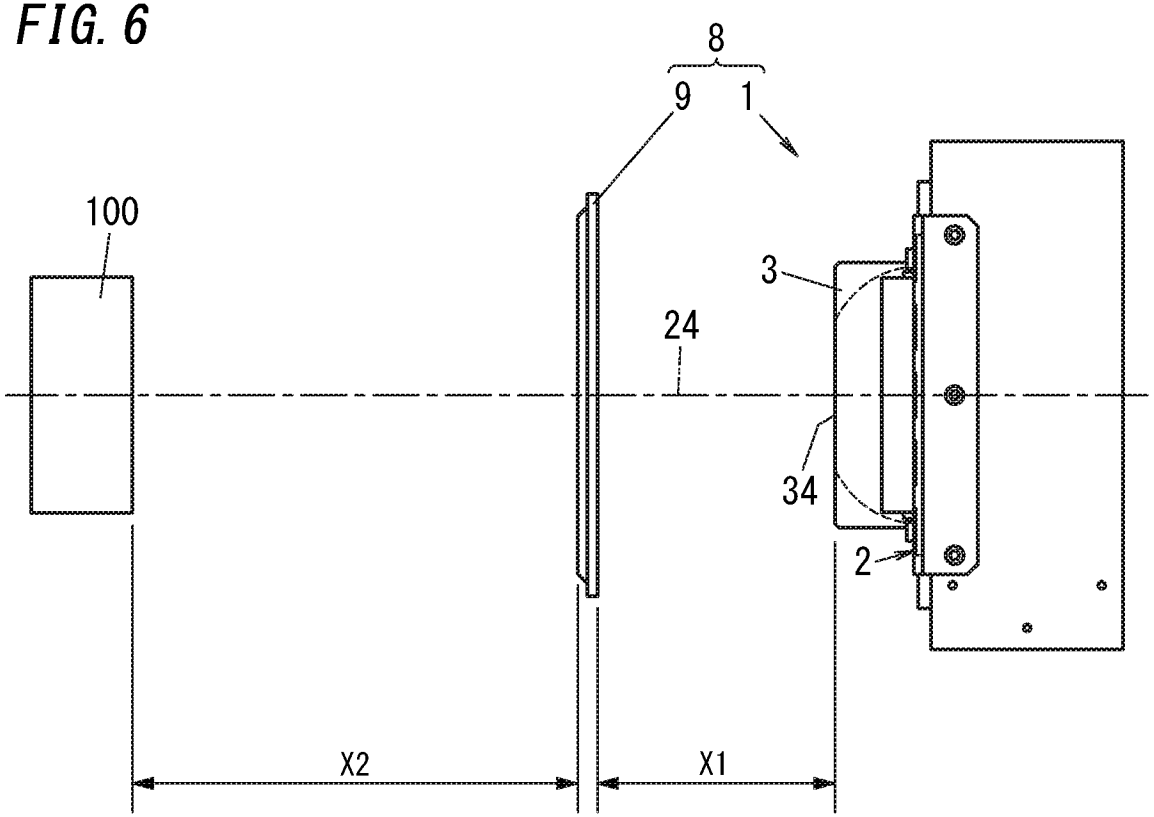
FIG. 6 is a schematic view illustrating the lighting device.

Next, a lighting device 8 according to the present embodiment will be described with reference to the drawings. As illustrated in FIG. 4, the lighting device 8 includes the light source device 1 and a luminous intensity distribution member 9. The luminous intensity distribution member 9 controls distribution of luminous intensity of light from the light source device 1. Examples of the luminous intensity distribution member 9 include Fresnel lens. For example, the luminous intensity distribution member 9 reduces the lighting angle of light collected to the luminous intensity distribution member 9. As illustrated in FIG. 6, the luminous intensity distribution member 9 is disposed on the axis 24 of the light source device 1 at a position away from the light source device 1. The distance between the luminous intensity distribution member 9 and the light source device 1 is denoted by X1. Light emitted from the opening 34 of the light source device 1 is collected to luminous intensity distribution member 9 and is distributed by the luminous intensity distribution member 9.

Figure 7:
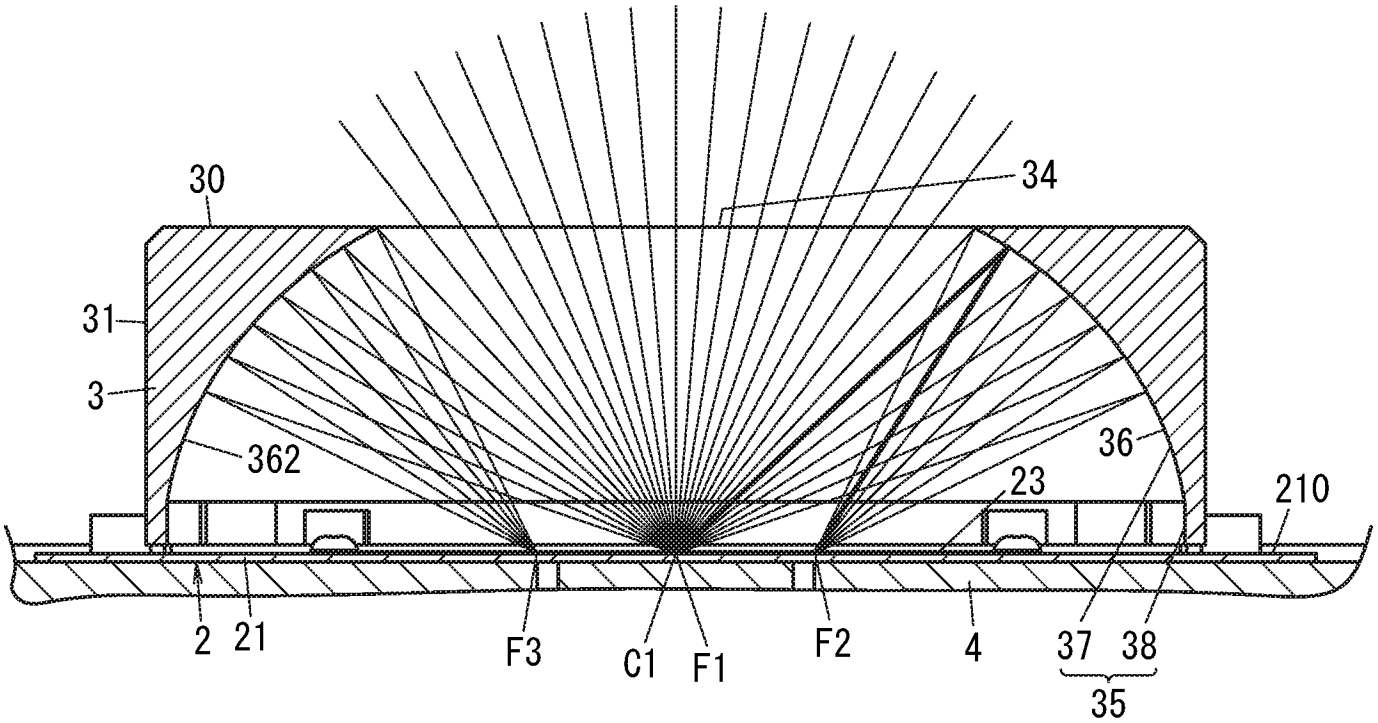
FIG. 7 is a sectional view illustrating a main portion of the light source device.

As described above, as illustrated in FIG. 1, the reflective surface 35 includes the curved surface 37 defined by rotating the first arc 36 which is a part of the ellipse 300 around the axis 24, and the first focal point F1 and the second focal point F2 of the ellipse 300 are located on the light-emitting face 23. In FIG. 7, optical paths of light emitted from the light-emitting face 23 are shown. As illustrated in FIG. 7, some rays of light emitted from the light-emitting face 23 are directly extracted to the outside of the light source device 1 (see FIG. 1) through the opening 34 while bypassing the reflective surface 35. On the other hand, some rays of light emitted from the second focal point F2 on the light-emitting face 23 travel along, for example, a path as indicated by thick lines in FIG. 7, i.e., arrive at and are reflected off the reflective surface 35 and are directed to the center C1 (first focal point F1) of the light-emitting face 23. The rays arrived at the center C1 are diffused or reflected, and some of the rays which are diffused or reflected are extracted via the opening 34 in the reflector 3 to the outside of the light source device 1. Since the reflective surface 35 has a rotationally symmetric shape to the axis 24 (see FIG. 1), some rays of light emitted from the point F3 which is line-symmetric with the second focal point F2 to the axis 24 are also reflected off the reflective surface 35 and are diffused or reflected at the center C1, and some of the rays which are diffused or reflected are extracted via the opening 34 to the outside of the light source device 1. Some rays of light emitted from each of points on a circumference having a diameter corresponding to a line connecting the second focal point F2 to the point F3 on the light-emitting face 23 are also reflected off the reflective surface 35 and are diffused or reflected at the center C1, and some of the rays which are diffused or reflected are extracted via the opening 34 to the outside of the light source device 1. Moreover, since the white resist is formed on the one surface 210, which is a forward surface of the substrate 21, light arrived at and reflected off the reflective surface 35 toward the light source 2 is efficiently reflected off the light source 2.

As described above, the illuminance of light extracted from the light source device 1 increases as compared to the case where the reflective surface 35 does not include the curved surface 37 defined by rotating the first arc 36 around the axis 24. Thus, in the lighting device 8, the illuminance of light emitted from the light source device 1 and distributed by the luminous intensity distribution member 9 also increases.

Table 1 below shows results of an experiment in which the illuminance of light emitted from the lighting device 8 of the present embodiment was measured. In the experiment, as illustrated in FIG. 6, an illuminance meter 100 was disposed at a position on the optical axis of light from the lighting device 8 and away from the lighting device 8 by a distance X2, and the illuminance (downright illuminance) on the optical axis was measured by the illuminance meter 100. The optical axis of the light from the lighting device 8 coincides with the axis 24. The distance X2 is 2500 mm and remains unchanged in the experiment. The downright illuminance was measured directly after turning on the lighting device 8. Moreover, as a comparative example, the downright illuminance of a lighting device using a light source device without the reflector 3 was also measured in a similar manner. In Table 1, X1 represents the distance from the light source device 1 to the luminous intensity distribution member 9. The distance X1 was measured with a reference point adjacent to the light source device 1 being the light-emitting face 23 in the comparative example and being the opening 34 in first and second examples. In this experiment, color temperatures of light-emitting elements 20 are equal to each other.

TABLE 1

| | Irradiation Diameter (mm) | X1 (mm) | Downright Illuminance (lx) |
|---|---|---|---|
| Comparative Example | About Φ1500 | 95 | 4120 |
| First Example | About Φ1500 | 95 | 7430 |
| Second Example | About Φ2800 | 32 | 4330 |

According to Table 1, the downright illuminance of the lighting device of the comparative example was 4120 lx (lux). In the first example, the downright illuminance was 7430 lx. The first example is under the same condition as the comparative example except that the light source device 1 includes the reflector 3. That is, in the lighting device 8 of the first example, the light source device 1 is provided with the reflector 3, and therefore, the downright illuminance was increased by a factor of 1.8 as compared to the case where the reflector 3 is not provided. As described above, the light source device 1 of the present embodiment is provided with the reflector 3, and therefore, an improvement in efficiency of light outcoupling from the light source 2 was observed.

Moreover, in the second example, the downright illuminance was measured under conditions that an angle at which light from the light source device 1 is distributed by the luminous intensity distribution member 9 is much wider than that of the first example so as to further extend the irradiation diameter of the lighting device 8, and the distance X1 from the light source device 1 to the luminous intensity distribution member 9 is shorter than that of the first example. As a result, in the second example, the downright illuminance was 4330 lx. That is, in the lighting device 8, the light source device 1 is provided with the reflector 3, and therefore, even when the irradiation diameter of the light emitted from the lighting device 8 is larger than that of the comparative example, reducing the distance X1 from the light source device 1 to the luminous intensity distribution member 9 provided the effect of reducing the degradation of the downright illuminance.

As described above, the light source device 1 of the present embodiment includes the light source 2 and the reflector 3. The light source 2 includes the light-emitting elements 20. The light source 2 includes the light-emitting face 23 being flat and formed of the light-emitting elements 20. The reflector 3 has the opening 34 on the axis 24. The axis 24 extends from the light-emitting face 23 and perpendicularly to the light-emitting face 23. The opening 34 is located in an area inside a peripheral edge of the light-emitting face 23 when viewed in a direction of the axis 24. Light emitted from the light source 2 passes through the opening 34. The reflector 3 includes the reflective surface 35 which reflects light emitted from the light source 2 toward the light source 2. The reflective surface 35 includes the curved surface 37 defined by rotating the first arc 36 (one arc) which is a part of the ellipse 300 around the axis 24. The ellipse 300 is coplanar with the axis 24. The closer the first arc 36 is to the opening 34 in the direction of the axis 24, the closer the first arc 36 is to the axis 24 in a direction orthogonal to the direction of the axis 24. The ellipse 300 including the first arc 36 has the first focal point F1 and the second focal point F2 which are located on the light-emitting face 23. The second focal point F2 is located adjacently to the first arc 36 with respect to the center C3 of the ellipse 300 including the first arc 36. The distance L1 from the first focal point F1 to the axis 24 is shorter than the distance L2 from the second focal point F2 to the axis 24.

With this configuration, in the light source device 1, light emitted from the second focal point F2 away from the axis 24 and traveling toward the reflective surface 35 is reflected off the reflective surface 35 and is collected to the first focal point F1 which is closer to the axis 24 than the second focal point F2 is. Thus, the light from the light source 2 is efficiently extracted via the opening 34 on the axis 24, and the light source device 1 enables extraction of light at high illuminance.

Moreover, the light source device 1 enables efficient extraction of light from the light-emitting elements 20 arranged not only in the vicinity of the axis 24 on the light-emitting face 23 but also in a large area including the second focal point F2. Thus, even when the number of the light-emitting elements 20 with respect to the area of the opening 34 is increased, light from the light source 2 can be efficiently extracted. In other words, even when the light radiation amount from the light-emitting elements 20 (the quantity of light obtained by subtracting light reflected off the light-emitting face 23 via the reflective surface 35 from light from the light-emitting face 23) increases, the light from the light source 2 can be efficiently extracted. Thus, the light source device 1 enables extraction of light at high illuminance.

Moreover, in the light source device 1 of the present embodiment, the first focal point F1 is on the axis 24.

Light emitted from the second focal point F2 toward the reflective surface 35 is reflected off the reflective surface 35, is collected to the first focal point F1 and then, passes through the opening 34 on the axis 24. This configuration enables light emitted from the second focal point F2 and reflected off the reflective surface 35 to be collected to the first focal point F1, that is, the intersection of the light-emitting face 23 and the axis 24. This further increases the light-outcoupling efficiency of the light source device 1.

Moreover, in the light source device 1 of the present embodiment, the light-emitting face 23 has a disk face shape. The axis 24 passes through the center C1 of the light-emitting face 23. The first focal point F1 is located at the center C1 of the light-emitting face 23. The opening 34 has a circular shape. The opening 34 has the center C2 on the axis 24.

Light emitted from the second focal point F2 toward the reflective surface 35 is reflected off the reflective surface 35, is collected to first focal point F1 and then, passes through the opening 34 provided on the axis 24. This configuration enables light emitted from the second focal point F2 and reflected off the reflective surface 35 to be collected to the first focal point F1, that is, the center C1 of the light-emitting face 23. Some rays of the light collected to the center C1 of the light-emitting face 23 pass through the opening 34 having the center C2 on the axis 24 passing through the center C1 of the light-emitting face 23. Moreover, since the light-emitting face 23 has the disk face shape, more light-emitting elements 20 may be arranged at and around the center C1 of the light-emitting face 23 and at and around the second focal point F2. This further increases the light-outcoupling efficiency of the light source device 1.

Moreover, in the light source device 1 of the present embodiment, the reflective surface 35 of the reflector 3 is made of metal which reflects light from the light source 2.

With this configuration, when the reflector 3 is made of metal, the light source device 1 can use the surface itself of the reflector 3 as the reflective surface 35. Moreover, when the reflective surface 35 is formed as a metal surface performing mirror reflection of light from the light source 2, the reflectance of the light from the light source 2 can be increased, and the light-outcoupling efficiency of the light source device 1 can be further increased.

Moreover, the lighting device 8 of the present embodiment includes the light source device 1 and the luminous intensity distribution member 9. The luminous intensity distribution member 9 is configured to control distribution of luminous intensity of light from the light source device 1.

This configuration enables the lighting device 8 to collect or distribute light emitted from the light source device 1 and collected to the luminous intensity distribution member 9 by the luminous intensity distribution member 9. The light source device 1 has an excellent light collection property, and therefore, even when a large number of light-emitting elements 20 are used to increase the area of the light-emitting face 23 in order to increase the illuminance of light emitted from the lighting device 8, a small-sized luminous intensity distribution member may be used as the luminous intensity distribution member 9, which enables a reduction in size and weight of the lighting device 8. Thus, the lighting device 8 is suitable for application to, in particular, spotlights.

(Second Embodiment)

Next, a light source device and a lighting device according to a second embodiment will be described. Note that the same components as those in the light source device 1 and the lighting device 8 according to the first embodiment are identified by the same reference signs, and the description thereof will be omitted.

A light source device 1 and a lighting device 8 of the present embodiment are different from the light source device 1 (see FIG. 2) of the first embodiment in that a light source 2 includes, as light-emitting elements 20, groups (in the present embodiment, two groups) of light-emitting elements 20, and the groups are different from each other in color temperature. That is, the light-emitting elements 20 are divided into two groups (first group and second group) depending on the color temperature. Each group includes two or more light-emitting elements 20. The light-emitting elements 20 included in the first group have the same color temperature. The light-emitting elements 20 included in the second group have the same color temperature. The color temperature of the light-emitting elements 20 in the first group is different from the color temperature of the light-emitting elements 20 in the second group. Moreover, the two or more light-emitting elements 20 in each of the first group and the second group are electrically connected in series, in parallel, or in series-parallel to each other. The light source device 1 is connected to, for example, a step-down chopper circuit of a power supply circuit. The power supply circuit adjusts the magnitude of a supply current to the light-emitting elements 20 in the first group to enable the light source device 1 to change the light output of the light-emitting elements 20 in the first group. The power supply circuit adjusts the magnitude of a supply current to the light-emitting elements 20 in the second group to enable the light source device 1 to change the light output of the light-emitting elements 20 in the second group. This changes the color of light extracted from the light source device 1.

As described above, in the light source device 1 of the present embodiment, the light source 2 includes, as the light-emitting elements 20, groups of light-emitting elements 20, and the groups of the light-emitting elements 20 are different from each other in color temperature. This configuration enables a change in color of light extracted from the light source device 1.

(Third Embodiment)

Next, a light source device and a lighting device according to a third embodiment will be described. Note that the same components as those in the light source device 1 and the lighting device 8 according to the first embodiment are identified by the same reference signs, and the description thereof will be omitted.

A light source device 1 of the present embodiment is different from the light source device 1 (see FIG. 1) of the first embodiment in that a reflective surface 35 of a reflector 3 is painted white.

This configuration enables the light source device 1 of the present embodiment to reduce the drop in color temperature of light in the light source device 1 before the light is extracted from the light source device 1.

Note that in addition to the above configuration, similarly to the second embodiment, the light source 2 may include, as light-emitting elements 20, groups of light-emitting elements 20, and the groups of the light-emitting elements 20 may be different from each other in color temperature.

(Variation)

As a variation of each of the embodiments, the light-emitting face 23 of the light source device 1 does not have to have a disk face shape. For example, the light-emitting face 23 may have a rectangular shape. Moreover, the axis 24 does not have to pass through the center C1 of the light-emitting face 23. Moreover, the first focal point F1 does not have to be located at the center C1 of the light-emitting face 23. For example, the first focal point F1 may be provided within an area defined by the opening 34 horizontally projected along the axis 24 onto the light-emitting face 23. Note that the distance L1 from the first focal point F1 to the axis 24 is shorter than the distance L2 from the second focal point F2 to the axis 24. Alternatively, the first focal point may be located at a point F4 in FIG. 1. Note that the distance L1 from a first focal point (the point F4) to the axis 24 is shorter than the distance L2 from the second focal point F2 to the axis 24. Moreover, the opening 34 does not have to have a circular shape. For example, the opening 34 may have a slit shape. Moreover, the center C2 of the opening 34 does not have to be on the axis 24. Moreover, the first focal point F1 does not have to be on the axis 24.

Also in the variation, in the light source device 1, light emitted from the second focal point F2 away from the axis 24 and traveling toward the reflective surface 35 is reflected off the reflective surface 35 and is collected to the first focal point F1 which is closer to the axis 24 than the second focal point F2 is, and the light can be efficiently extracted.

Moreover, since the reflective surface 35 is required only to include the curved surface 37 defined by rotating the first arc 36 around the axis 24, for example, the entirety of the reflective surface 35 may be the curved surface 37 defined by turning the first arc 36 around the axis 24. Moreover, the reflective surface 35 may have a flat surface portion adjacent to the substrate 21 of the light source 2 and/or a flat surface portion in the periphery of the opening 34.

Moreover, the curved surface 37 is not limited to a curved surface defined by rotating the first arc 36 around the axis 24 by 360 degrees but may be a curved surface defined by rotating the first arc 36 around the axis 24 by an arbitrary degrees (other than 360 degrees).

Moreover, the opening 34 may be covered with a resin or glass which is light-transmissive.

Moreover, the reflective surface 35 of the reflector 3 does not have to be a metal surface. For example, the reflective surface 35 may be made from a multilayer film reflection mirror.

Moreover, the reflective surface 35 of the reflector 3 may be a metal surface formed on a surface of a non-metal material by, for example, insert molding.

Moreover, the luminous intensity distribution member 9 is not limited to the Fresnel lens. That is, as the luminous intensity distribution member 9, various types of lenses, reflection mirrors, prisms, diffusion panels, and the like may be used. Moreover, the luminous intensity distribution member 9 may increase the lighting angle, collect light to one point, distribute light to produce parallel rays, or perform diffusion distribution of light instead of reducing the lighting angle of light from the light source device 1.

While the foregoing has described what are considered to be the best mode and/or other examples, it is understood that various modifications may be made therein and that the subject matter disclosed herein may be implemented in various forms and examples, and that they may be applied in numerous applications, only some of which have been described herein. It is intended by the following claims to claim any and all modifications and variations that fall within the true scope of the present teachings.

The invention claimed is:

1. A light source device, comprising:

a light source including light-emitting elements, the light source including a light-emitting face being flat and formed of the light-emitting elements; and a reflector having an opening on an axis extending from the light-emitting face and perpendicularly to the light-emitting face, wherein the opening is located in an area inside a peripheral edge of the light-emitting face when viewed in a direction of the axis, light emitted from the light source passes through the opening, the reflector includes a reflective surface which reflects light emitted from the light source toward the light source, the reflective surface includes a curved surface defined by rotating one arc around the axis, the one arc being a part of an ellipse located coplanar with the axis, and the closer the one arc is to the opening in the direction of the axis, the closer the one arc is to the axis in a direction orthogonal to the direction of the axis, the ellipse including the one arc has a first focal point and a second focal point which are located on the light-emitting face, the second focal point is located adjacently to the one arc with respect to a center of the ellipse including the one arc, and a distance from the first focal point to the axis is shorter than a distance from the second focal point to the axis.

2. The light source device according to claim 1, wherein the first focal point is on the axis.

3. The light source device according to claim 2, wherein the light-emitting face has a disk face shape, the axis passes through a center of the light-emitting face, the first focal point is located at the center of the light-emitting face, the opening has a circular shape, and the opening has a center on the axis.

4. The light source device according to claim 3, wherein the reflective surface of the reflector is made of metal which reflects light from the light source.

5. The light source device according to claim 4, wherein the light source includes, as the light-emitting elements, groups of light-emitting elements, and the groups of the light-emitting elements are different from each other in color temperature.

6. The light source device according to claim 4, wherein the reflective surface of the reflector is painted white.

7. The light source device according to claim 3, wherein the light source includes, as the light-emitting elements, groups of light-emitting elements, and the groups of the light-emitting elements are different from each other in color temperature.

8. The light source device according to claim 3, wherein the reflective surface of the reflector is painted white.

9. The light source device according to claim 2, wherein the reflective surface of the reflector is made of metal which reflects light from the light source.

10. The light source device according to claim 9, wherein the light source includes, as the light-emitting elements, groups of light-emitting elements, and the groups of the light-emitting elements are different from each other in color temperature.

11. The light source device according to claim 9, wherein the reflective surface of the reflector is painted white.

12. The light source device according to claim 2, wherein the light source includes, as the light-emitting elements, groups of light-emitting elements, and the groups of the light-emitting elements are different from each other in color temperature.

13. The light source device according to claim 2, wherein the reflective surface of the reflector is painted white.

14. The light source device according to claim 1, wherein the reflective surface of the reflector is made of metal which reflects light from the light source.

15. The light source device according to claim 14, wherein the light source includes, as the light-emitting elements, groups of light-emitting elements, and the groups of the light-emitting elements are different from each other in color temperature.

16. The light source device according to claim 14, wherein the reflective surface of the reflector is painted white.

17. The light source device according to claim 1, wherein the light source includes, as the light-emitting elements, groups of light-emitting elements, and the groups of the light-emitting elements are different from each other in color temperature.

18. The light source device according to claim 17, wherein the reflective surface of the reflector is painted white.

19. The light source device according to claim 1, wherein the reflective surface of the reflector is painted white.

20. A lighting device, comprising:

the light source device according to claim 1; and a luminous intensity distribution member configured to control distribution of luminous intensity of light from the light source device.

* * * * *